US007834738B2

(12) United States Patent
Muench, Jr. et al.

(10) Patent No.: US 7,834,738 B2
(45) Date of Patent: Nov. 16, 2010

(54) CURRENT LIMITING FUSE

(75) Inventors: Frank J. Muench, Jr., Waukesha, WI (US); Allen LeRoy Johnson, Mukwonago, WI (US); Gordon Thomas Borck, Waukesha, WI (US); Russell John Lenz, Waukesha, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 12/272,260

(22) Filed: Nov. 17, 2008

(65) Prior Publication Data

US 2009/0079533 A1 Mar. 26, 2009

Related U.S. Application Data

(62) Division of application No. 11/004,228, filed on Dec. 6, 2004, now Pat. No. 7,477,129.

(51) Int. Cl.
*H01H 85/02* (2006.01)

(52) U.S. Cl. ..... 337/228; 337/186; 337/248; 337/204

(58) Field of Classification Search ..... 337/186, 337/228, 248, 204
See application file for complete search history.

(56) References Cited

U.S. PATENT DOCUMENTS

| | | | | | |
|---|---|---|---|---|---|
| 1,262,683 | A | | 4/1918 | Lewis et al. | |
| 1,716,884 | A | | 6/1929 | Goss | |
| 1,965,391 | A | * | 7/1934 | Pittman et al. | 337/285 |
| 2,108,993 | A | * | 2/1938 | Ramsey | 337/202 |
| 2,172,143 | A | * | 9/1939 | Lemmon | 337/214 |
| 2,291,646 | A | * | 8/1942 | Ramsey | 337/178 |
| 2,291,647 | A | * | 8/1942 | Ramsey | 337/287 |
| 2,365,113 | A | * | 12/1944 | Schultz | 337/170 |
| 2,386,752 | A | * | 10/1945 | Schultz | 337/239 |
| 2,458,948 | A | * | 1/1949 | Lincks | 337/202 |
| 2,546,074 | A | | 3/1951 | Lindell | |
| 2,591,949 | A | * | 4/1952 | Lindell et al. | 439/698 |
| 2,594,315 | A | | 4/1952 | Kozacka | |
| 2,639,350 | A | | 5/1953 | Cox | |
| 2,662,947 | A | * | 12/1953 | Kyle, Jr. | 337/144 |
| 2,672,540 | A | | 3/1954 | Dewey | |
| 2,918,557 | A | * | 12/1959 | Link | 337/194 |
| 3,014,158 | A | * | 12/1961 | Nelson et al. | 361/41 |
| 3,189,712 | A | | 6/1965 | Kozacka | |
| 3,210,604 | A | * | 10/1965 | Nelson | 361/41 |
| 3,249,719 | A | * | 5/1966 | Misare et al. | 337/32 |

(Continued)

OTHER PUBLICATIONS

PCT International Search Report (Application No. PCT/US05/43986), mailed Mar. 21, 2007, 5 total pages.

(Continued)

*Primary Examiner*—Anatoly Vortman
(74) *Attorney, Agent, or Firm*—Fish & Richardson P.C.

(57) ABSTRACT

A mounting assembly couples a current limiting fuse to an element that defines a longitudinal axis. The mounting assembly includes a mounting member on the element; a first attachment member coupled to the mounting member in a fixed position relative to the mounting member; and a second attachment member coupleable to the current limiting fuse. The first and second attachment members are configured to be attached to one another in a plurality of discreet positions about an axis that is non-parallel to the longitudinal axis.

21 Claims, 12 Drawing Sheets

U.S. PATENT DOCUMENTS

| | | | | | |
|---|---|---|---|---|---|
| 3,250,879 | A | | 5/1966 | Jacobs, Jr. | |
| 3,365,616 | A | * | 1/1968 | Hermann | 361/41 |
| 3,435,291 | A | * | 3/1969 | Paulus | 361/41 |
| 3,636,491 | A | | 1/1972 | Cameron | |
| 3,644,861 | A | | 2/1972 | Fister | |
| 3,863,187 | A | | 1/1975 | Mahieu et al. | |
| 3,938,067 | A | | 2/1976 | Fister | |
| 3,946,351 | A | | 3/1976 | Bronikowski et al. | |
| 3,953,818 | A | * | 4/1976 | Martin et al. | 337/191 |
| 3,983,526 | A | | 9/1976 | Koch | |
| 4,035,753 | A | | 7/1977 | Reeder | |
| 4,146,862 | A | | 3/1979 | Mikulecky | |
| 4,150,353 | A | | 4/1979 | Huber et al. | |
| 4,172,246 | A | * | 10/1979 | Cuzzone | 337/191 |
| 4,205,294 | A | | 5/1980 | Jacobs, Jr. | |
| 4,215,331 | A | | 7/1980 | Kozacka | |
| 4,274,073 | A | | 6/1981 | Luck et al. | |
| 4,278,316 | A | | 7/1981 | White | |
| 4,320,375 | A | * | 3/1982 | Lien | 337/204 |
| 4,373,772 | A | * | 2/1983 | Lorenzen et al. | 439/551 |
| 4,506,249 | A | | 3/1985 | Huber et al. | |
| 4,625,196 | A | * | 11/1986 | Muench et al. | 337/204 |
| 4,638,283 | A | | 1/1987 | Frind et al. | |
| 4,684,915 | A | | 8/1987 | Knapp, Jr. | |
| 4,743,996 | A | * | 5/1988 | Book | 361/39 |
| 4,746,381 | A | | 5/1988 | Parker et al. | |
| 4,752,760 | A | | 6/1988 | Clark | |
| 4,761,148 | A | | 8/1988 | Sappington | |
| 4,888,573 | A | | 12/1989 | Dunn | |
| 5,003,281 | A | | 3/1991 | Reese | |
| 5,227,758 | A | * | 7/1993 | Ranjan | 337/204 |
| 5,559,488 | A | * | 9/1996 | Hassler et al. | 337/158 |
| 5,583,729 | A | * | 12/1996 | Hassler et al. | 361/39 |
| 5,659,282 | A | | 8/1997 | Nemoto | |
| 5,670,926 | A | | 9/1997 | Ranjan et al. | |
| 5,886,613 | A | | 3/1999 | Magoon et al. | |
| 5,936,507 | A | * | 8/1999 | Borck et al. | 337/204 |
| 5,963,123 | A | | 10/1999 | Douglass | |
| 5,994,994 | A | | 11/1999 | Ito et al. | |
| 6,147,585 | A | | 11/2000 | Kalra et al. | |
| 6,194,989 | B1 | | 2/2001 | Douglass | |
| 6,212,742 | B1 | * | 4/2001 | Baskin | 24/457 |
| 6,538,550 | B1 | | 3/2003 | Muench, Jr. et al. | |
| 6,538,551 | B2 | | 3/2003 | Henricks | |
| 6,624,736 | B1 | * | 9/2003 | Cotton et al. | 337/203 |
| 6,778,061 | B2 | | 8/2004 | Nakano et al. | |
| 6,798,330 | B2 | | 9/2004 | Arikawa et al. | |
| 7,477,129 | B2 | * | 1/2009 | Muench et al. | 337/228 |
| 2004/0239473 | A1 | * | 12/2004 | Van Heerden | 337/171 |

OTHER PUBLICATIONS

PCT Written Opinion (Application No. PCT/US05/43986), mailed Mar. 21, 2007, 7 total pages.

* cited by examiner

CURRENT LIMITING FUSE

CROSS REFERENCE TO RELATED APPLICATION

This application is a divisional of U.S. application Ser. No. 11/004,228, filed on Dec. 6, 2004, which is incorporated herein by reference in its entirety.

TECHNICAL FIELD

This disclosure relates to current limiting fuses for high voltage, high current applications.

BACKGROUND

Current limiting fuses are used with high voltage applications, such as high voltage power lines and transformers. Examples of current limiting fuses can be found in U.S. Pat. No. 6,538,550, which is incorporated by reference. Current limiting fuses generally include an insulating cylindrical housing that contains a metal fuse element encased in silica sand. The housing is enclosed on either end by metallic end caps that are attached with an adhesive, such as epoxy. When an excessive current is applied, the metal fuse element melts to break the electrical circuit. When the fuse element melts, high pressures are created inside the fuse, which can cause the end plates to become separated from the housing.

In transformers, such current limiting fuses can be electrically connected to other fuses. For example, a current limiting fuse may be connected in series with a bayonet fuse, such as is described in U.S. Pat. No. 5,936,507, which is incorporated by reference.

SUMMARY

In an aspect, a housing for a current limiting fuse includes a metal fuse element and a non-conductive filler material, where the fuse element is configured to melt to create an open circuit when an applied current exceeds a threshold amount (e.g., between about 2 to about 1200 amperes). The housing includes first and second cylindrical members. The first cylindrical member has an open end portion and the second cylindrical member has an integrally formed closed end portion and an open end portion configured to be attached to the open end portion of the first cylindrical member to close the housing. The housing also includes a fastening member configured to prevent the open end portion of the first cylindrical member from separating from the open end portion of the second cylindrical member when the fuse element melts.

Implementations of this aspect may include one or more of the following features.

The first cylindrical member may include an integrally formed closed end portion at an end of the first cylindrical member opposite from the open end portion. The first cylindrical member may be substantially longer than the second cylindrical member. The first cylindrical member may include a tube and the second cylindrical member may include a cap. The first and second cylindrical members may be about the same length. The first cylindrical member may include a first tubular member and the second cylindrical member may include a second tubular member.

The first cylindrical member may include a second open end portion opposite the end portion of the first cylindrical member. A metal end plate may be attached to the second end portion of the first cylindrical member. A third cylindrical end portion that has an integrally formed closed end portion and an open end portion may be configured to be attached to the second open end portion of the first cylindrical member. The first cylindrical member may include a tube, the second cylindrical member may include a cap, and the third cylindrical member may include a cap.

The fastening member may include a clip that is coupled to the first and second cylindrical members or may include threads on the first and second cylindrical members. An adhesive may further secure the first and second cylindrical members to one another. A sealing member, such as an O-ring, may be disposed between the first and second cylindrical members. The current limiting fuse may be configured to be used with voltage between about 5 kV and about 38 kV.

In another aspect, a fuse assembly includes a housing that includes first and second cylindrical members. The first cylindrical member has an open end portion and the second cylindrical member has an integrally formed closed end portion and an open end portion configured to be attached to the open end portion of the first cylindrical member to close the housing. The fuse assembly also includes a current limiting fuse that includes a metal fuse element and a non-conductive filler material received in the housing. The fuse element is configured to melt to create an open circuit when an applied current exceeds a threshold amount (e.g., between about 2 and about 1200 amperes). The fuse assembly also includes a fastening member configured to prevent the open end portion of the first cylindrical member from separating from the open end portion of the second cylindrical member when the fuse element melts.

Implementations of this aspect may include one or more of the following features.

The first cylindrical member may include an integrally formed closed end portion at an end of the first cylindrical member opposite from the open end portion. The first cylindrical member may be substantially longer than the second cylindrical member. The first cylindrical member may include a tube and the second cylindrical member may include a cap. The first and second cylindrical members may be about the same length. The first cylindrical member may include a first tubular member and the second cylindrical member may include a second tubular member.

The first cylindrical member may include a second open end portion opposite the end portion of the first cylindrical member. A metal end plate may be attached to the second end portion of the first cylindrical member. A third cylindrical end portion that has an integrally formed closed end portion an open end portion may be configured to be attached to the second open end portion of the first cylindrical member.

The fastening member may include a clip that is coupled to the first and second cylindrical members or may include threads on the first and second cylindrical members. An adhesive may further secure the first and second cylindrical members to one another. A sealing member may be disposed between the first and second cylindrical members. The current limiting fuse may be configured to be used with voltage between about 5 kV and about 38 kV.

In another aspect, a housing for a current limiting fuse includes a metal fuse element and a non-conductive filler material, where the fuse element is configured to melt to create an open circuit when an applied current exceeds a threshold amount (e.g., between about 2 and about 1200 amperes). The housing includes a cylindrical member with an open end portion, a cap portion configured to be attached to the open end portion of the cylindrical member to close the housing, and a joining member configured to attach the cap portion to the cylindrical member by other than an adhesive bond to prevent separation of the cap portion and the cylindrical member when the fuse element melts.

Implementations of this aspect may include one or more of the following features. The cylindrical member may include an integrally formed closed end portion at an end of the cylindrical member opposite the open end portion. The cylindrical member may include a second open end portion opposite the end portion of the cylindrical member. A metal end plate may be attached to the second open end portion of the cylindrical member. A second cap portion may be configured to be attached to the second open end portion of the cylindrical member to close the housing and a second joining member configured to attach the cap portion to the cylindrical member by other than an adhesive bond. The joining member may include a clip that is coupled to the first and second cylindrical members or threads on the cylindrical member and on the cap. An adhesive may further secure the cylindrical member and the cap. A sealing member, such as an O-ring, may be disposed between the cylindrical member and the cap. The current limiting fuse may be configured to be used with voltage between about 5 kV and about 38 kV.

In another aspect, a fuse assembly includes a housing that includes a cylindrical member with an open end and a cap portion configured to be attached to the open end portion of the cylindrical member to close the housing. A current limiting fuse that includes a metal fuse element and a non-conductive filler material is received in the housing. The fuse element is configured to melt to create an open circuit when an applied current exceeds a threshold amount (e.g., between about 2 and about 1200 amperes). A joining member is configured to attach the cap portion to the cylindrical member by other than an adhesive bond to prevent separation of the cap portion and the cylindrical member when the fuse element melts.

Implementations of this aspect may include one or more of the following features. The cylindrical member may include an integrally formed closed end portion at an end of the cylindrical member opposite the open end portion. The cylindrical member may include a second open end portion opposite the end portion of the cylindrical member. A metal end plate may be attached to the second open end portion of the cylindrical member. A second cap portion may be configured to be attached to the second open end portion of the cylindrical member to close the housing and a second joining member may be configured to attach the cap portion to the cylindrical member by other than an adhesive bond. The joining member may include a clip that is coupled to the first and second cylindrical members or threads on the cylindrical member and on the cap. An adhesive may further secure the cylindrical member and the cap. A sealing member may be disposed between the cylindrical member and the cap. The current limiting fuse may be configured to be used with voltage between about 5 kV and about 38 kV.

In another aspect, a mounting assembly for coupling a current limiting fuse to an element that defines a longitudinal axis is disclosed. The mounting assembly includes a mounting member configured to be mounted to the element in a plurality of positions about the longitudinal axis. A first attachment member is coupled to the mounting member in a fixed position relative to the mounting member. A second attachment member is coupleable to the current limiting fuse. The first and second attachment members are configured to be attached to one another in a plurality of discreet positions about an axis that is non-parallel to the longitudinal axis.

Implementations of this aspect may include one or more of the following features.

The element may include a bayonet fuse. The bayonet fuse may have a tube having a square cross section and the mounting member may be adjustable about the longitudinal axis in 90 degree intervals. The element may include a wall and the longitudinal axis may be perpendicular to the wall. The mounting member may include an L-shaped bracket with a leg configured to be mounted to the wall.

The mounting member may include a first piece and a second piece. The first piece may define a slot and the second piece may have a tab that fits into the slot. The mounting member may include a fastener for attaching the first member to the second member. The first piece may have a first concave portion and the second portion may have a second concave portion, the first and second concave portions facing each other to receive the element therebetween. The first concave portion may include a first flattened region and the second concave portion may include a second flattened region, the first and second flattened regions allow the mounting member to be mounted to the element at a plurality of discreet positions. The first attachment member may include a socket that includes a plurality of grooves. The second attachment member may include a projection that includes a plurality of teeth corresponding to the grooves.

A third attachment member may be coupled to the mounting member in a fixed position relative to the mounting member, such that the second attachment member is configured to be attached to the first attachment member or the third attachment member in a plurality of discreet positions about an axis that is non-parallel to the longitudinal axis. A third attachment member may be couplable to the current limiting fuse, such that the first attachment member is configured to be attached to the second attachment member or the third attachment member in a plurality of discreet positions about an axis that is non-parallel to the longitudinal axis. The second attachment member may be integral with and/or removable from the current limiting fuse. The second attachment member may be integral with a clamp that may be removably couplable to the current limiting fuse.

The details of one or more implementations are set forth in the accompanying drawings and the description below. Other features and advantages will be apparent from the description and drawings, and from the claims.

DETAILED DESCRIPTION

Figure 1:
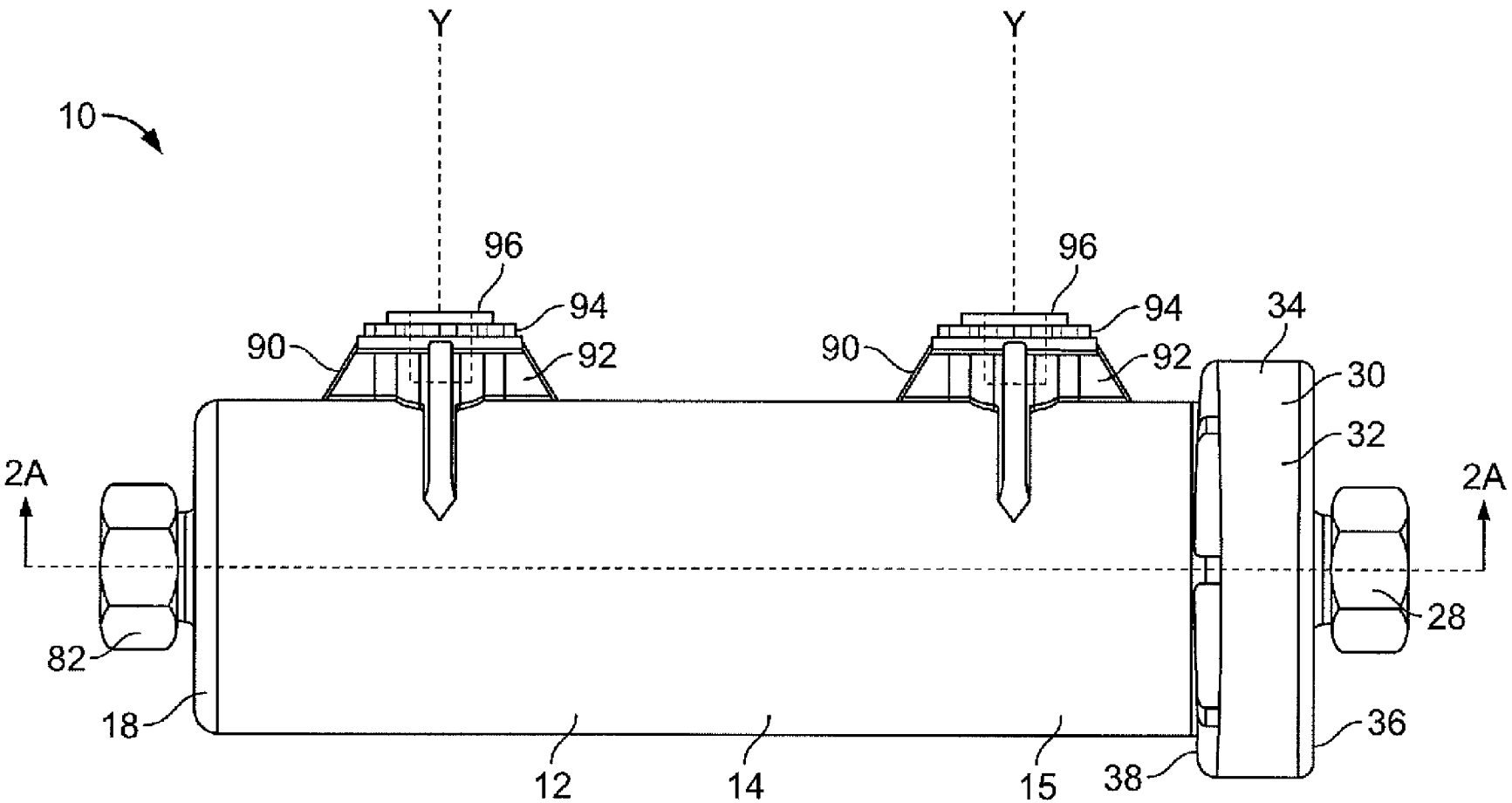
FIG. 1 is a side view of a current limiting fuse assembly.
Figure 2A:
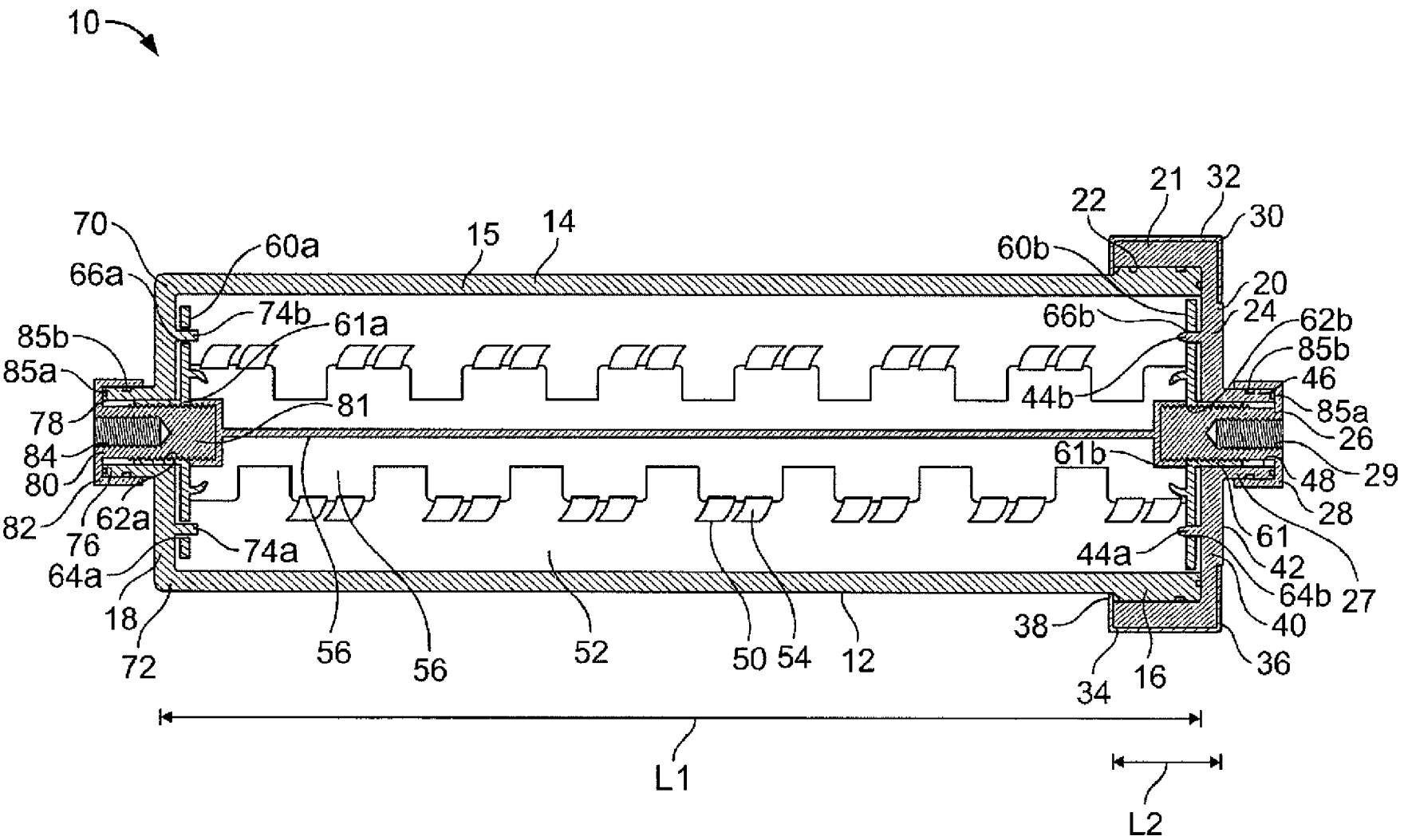
FIG. 2A is a cross-sectional view of the fuse assembly of FIG. 1 taken along line 2A-2A.

FIGS. 1 and 2A show a current limiting fuse assembly 10 for use in high voltage (e.g, between about 5 kV and about 38 kV) applications, such as for coupling a high voltage power line to a transformer or to another power line. This coupling may be done directly or through another fuse. Fuse assembly 10 includes a housing 12 that contains a fuse element 50 and a non-conductive filler material 52, such as silica sand. The fuse element 50 is configured to melt and fuse with the filler material 52 to create an open circuit when the applied current exceeds a threshold amount, thus interrupting current flow through fuse assembly 10. For example, the threshold amount may be about two to three times the current rating of the fuse, which may be between about 1 and about 400 amperes, yielding a threshold amount of between about 2 and about 1200 amperes.

Housing 12 includes a tubular member 14 with a cylindrical wall 15, an open end portion 16, and an integrally formed closed end portion 18. Fuse assembly 10 also includes a cylindrical cap 20 with a cylindrical wall 21, an open end portion 22, and an integrally formed closed end portion 24. Cap 20 has a length L2 that is substantially shorter than a length L1 of tubular member 14. When attached, open end portion 24 of cap 20 fits snugly over open end portion 16 of tubular member 14 to close housing 12. Housing 12 further includes a joining or fastening member 30 configured to attach cap 20 to tubular member 12 by other than an adhesive bond to prevent separation of cap 20 and tubular member 12 when the fuse element melts. Housing 12 and cap 20 are composed of a substantially rigid insulating material, such as ceramic or fiberglass reinforced plastic materials, and are each formed as a single-piece by a process such as injection molding.

Fuse element 50 includes a conductive element 54 that is helically wound around a non-conductive core 56. Conductive element 54 is formed from a conductive metal, such as, for example, a copper or silver alloy, that melts at an appropriate temperature for the amperage rating of the fuse. Conductive element 54 is attached at either end to disc-shaped conductive end plates 60*a* and 60*b*.

Figure 2B:
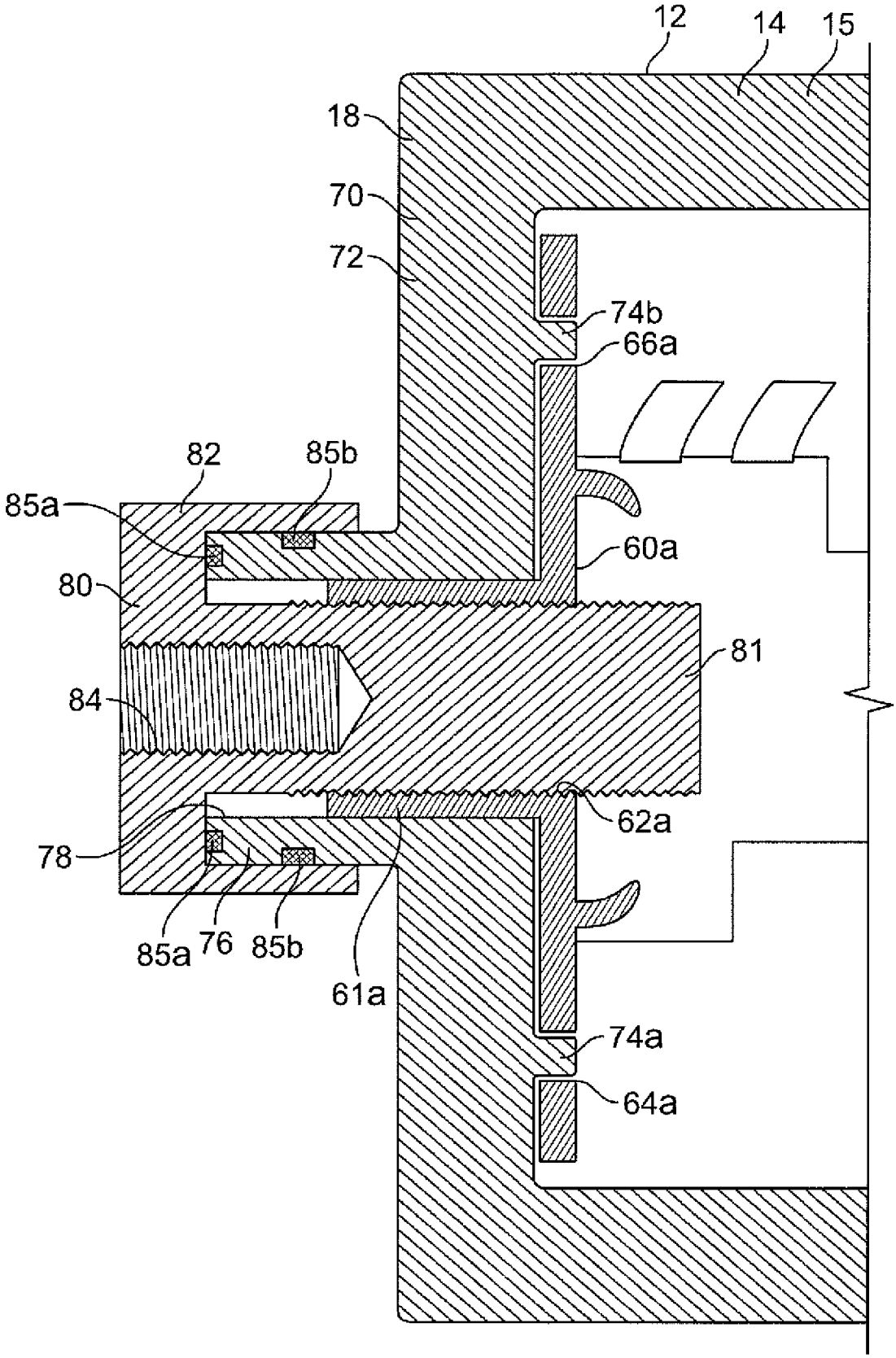
FIG. 2B is an enlarged cross-sectional view of a closed end portion of the fuse assembly of FIG. 2A.

Referring also to FIG. 2B, end plate 60*a* defines off-center apertures 64*a* and 66*a* and includes a cylindrical boss 61*a* that defines a threaded central bore 62*a*. The closed end portion 18 of tubular member 14 includes a wall portion 70 that is integrally formed with cylindrical wall 15, such as by being molded as a single piece with cylindrical wall 15. Wall portion 70 includes a disc-shaped portion 72 with nubs 74*a* and 74*b* that project into the housing and that are received in off-center apertures 64*a* and 66*a* of end plate 60*a* to prevent rotation of end plate 60*a* relative to housing 12.

Wall portion 70 also includes an outwardly projecting annular flange 76 that defines a central bore 78 through wall portion 70. Received through central bore 78 is boss 61*a* of end plate 60*a*. Received in threaded central bore 62*a* of boss 61*a* and forming an electrical contact with end plate 60*a* is a threaded elongated portion 81 of a conductive bushing 80. Bushing 80 also includes a cap portion 82 that wraps around the exterior of flange 76. Extending partially through bushing 80 is a threaded bore 84 that is configured for attachment to another piece of electrical equipment, such as, for example, a high voltage power line, a transformer, or another fuse assembly. Disposed between conductive bushing 80 and wall portion 70 are sealing members, such as rubber O-rings 85*a* and 85*b*, that help form a seal between bushing 80 and wall portion 70.

Figure 2C:
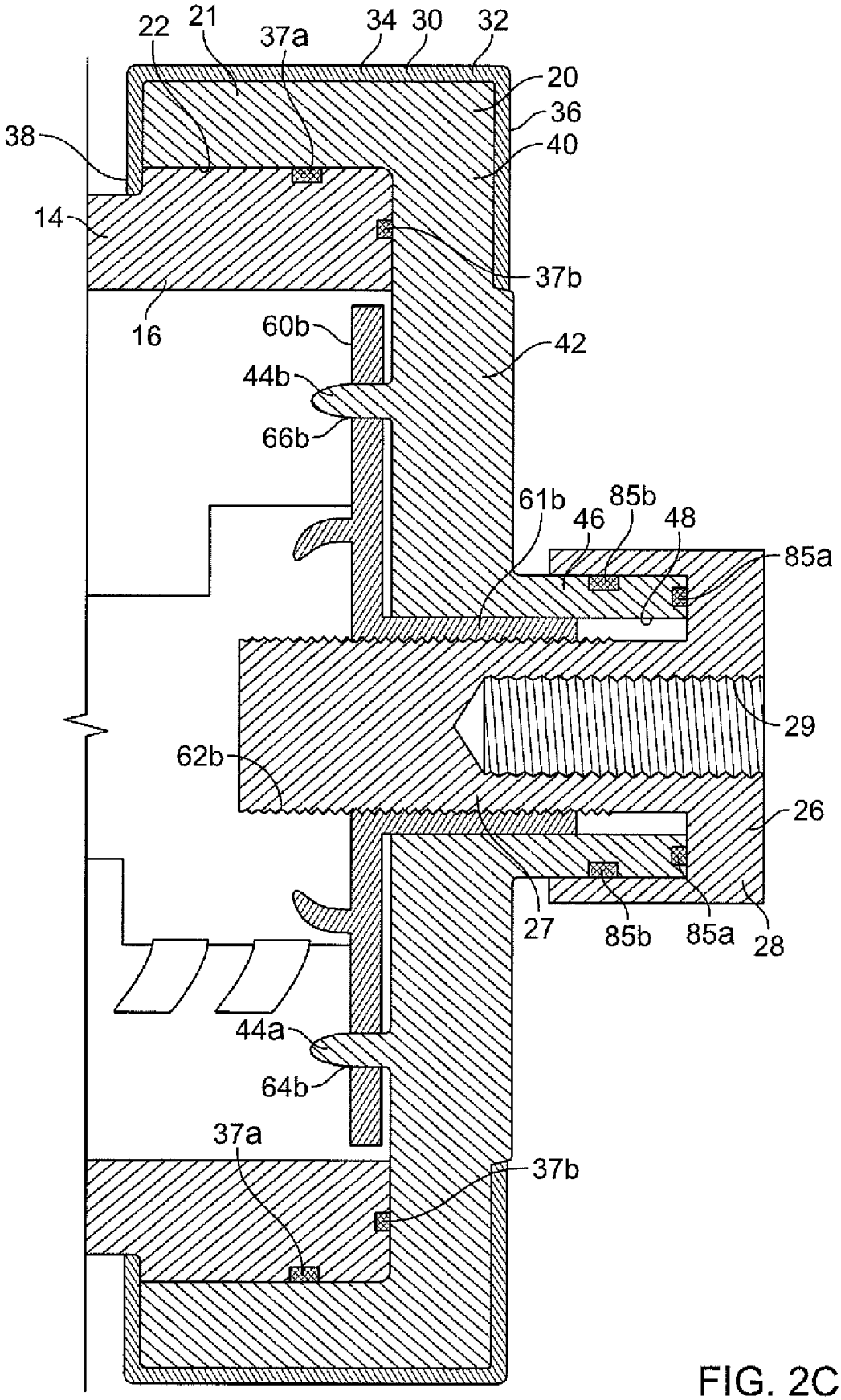
FIG. 2C is an enlarged cross-sectional view of an open end portion of the fuse assembly of FIG. 2A.

Referring also to FIG. 2C, end plate 60*b* defines off-center apertures 64*b* and 66*b* and includes a cylindrical boss 61*b* that defines a threaded central bore 62*b*. The cap 20 includes a wall portion 40 integrally formed with a cylindrical wall 21, such as by being molded as a single piece. Cylindrical portion 21 of cap 20 fits over end portion 16 of cylindrical portion 14. Disposed between cap 20 and end portion 16 are sealing members, such as O-rings 37*a* and 37*b* that help form a seal between cap 20 and end portion 16. Wall portion 40 includes a disc-shaped portion 42 with nubs 44*a* and 44*b* that project into the housing and that are received in off-center apertures 64*b* and 66*b* of end plate 60*b* to prevent rotation of end plate 60*b* relative to housing 12.

Wall portion 40 also includes an outwardly projecting annular flange 46 that defines a central bore 48 through wall portion 40. Received through central bore 48 is boss 61*b* of end plate 60*b*. Received in threaded central bore 62*b* of boss 61*b* and forming an electrical contact with end plate 60*b* is a threaded elongated portion 27 of a conductive bushing 26. Bushing 26 also includes a cap portion 28 that wraps around the exterior of flange 46. Extending partially through bushing 26 is a threaded bore 29 that is configured for attachment to another piece of electrical equipment, such as, for example, a high voltage power line, a transformer, or another fuse assembly. Disposed between conductive bushing 26 and wall portion 40 are sealing members, such as rubber O-rings 85*a* and 85*b*, that help form a seal between bushing 26 and wall portion 40.

Joining or fastening member 30 includes a ring-shaped clip 32 having a side wall 34, a top wall 36, and fingers 38. Clip 32 is inserted over cap 20 so that the side wall 34 of clip 32 abuts the cylindrical wall 21, and the top wall 36 of clip 32 abuts the disc-shaped portion 42 of the wall portion 40. Fingers 38 are then crimped so that they clamp against an annular flange 17 that is formed on the open end portion 16 of the tubular member 14. In this way, clip 32 fastens cap 20 to tubular member 14 to help prevent separation of cap 20 and tubular member 14 when fuse element 50 melts.

Figure 3:
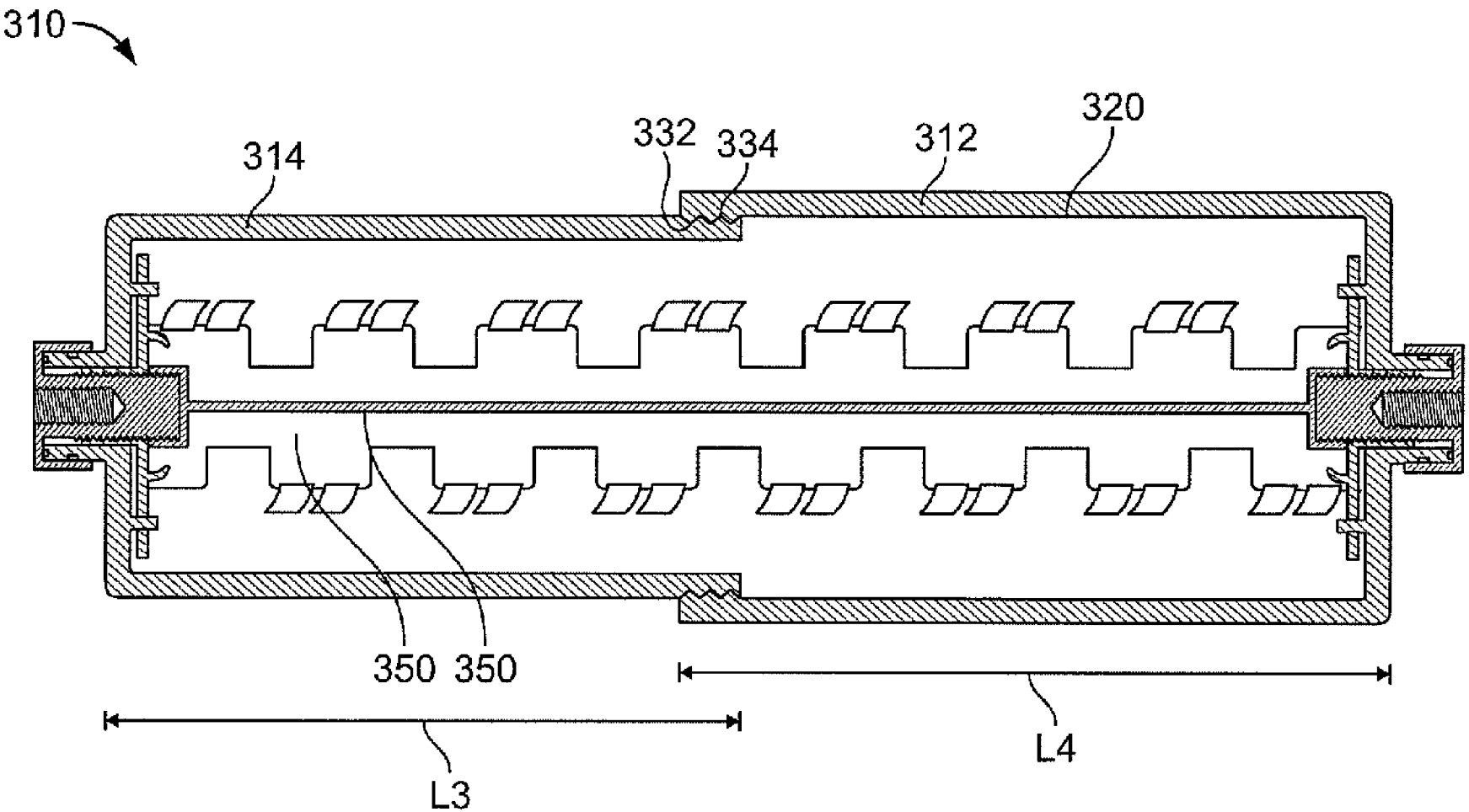
FIG. 3 is a cross-sectional view of another implementation of a current limiting fuse assembly.

Referring to FIG. 3, in another implementation, a current limiting fuse assembly 310 includes a housing 312 that contains a fuse element 350 that is analogous to the fuse element 50 described with respect to FIGS. 1 and 2. Housing 312 differs from housing 12, described above, as follows. Housing 312 includes a first tubular member 314 that is analogous to tubular member 14, described above, but that has a length L3 that is about half of the length L1 of tubular member 14. Housing also includes a second tubular member 320, rather than cap 20. Second tubular member 320 is virtually a mirror image of first tubular member 314 and has a length L4 that is approximately the same as the length L3 of first tubular member 314. First and second tubular members 314 and 320 have approximately the same length, so that they are attached to one another in about the middle of housing 12. In addition, rather than clip 32, as described above, housing 312 includes a joining or fastening member 330 in the form of external threads 332 on an outer surface 315 of first tubular member 314 and internal threads 334 on an inner surface 325 of second tubular member 320. Threads 332 and 334 interlock with each other to prevent separation of the first tubular member 314 from the second tubular member 320 when the fuse element 350 melts.

Figure 4:
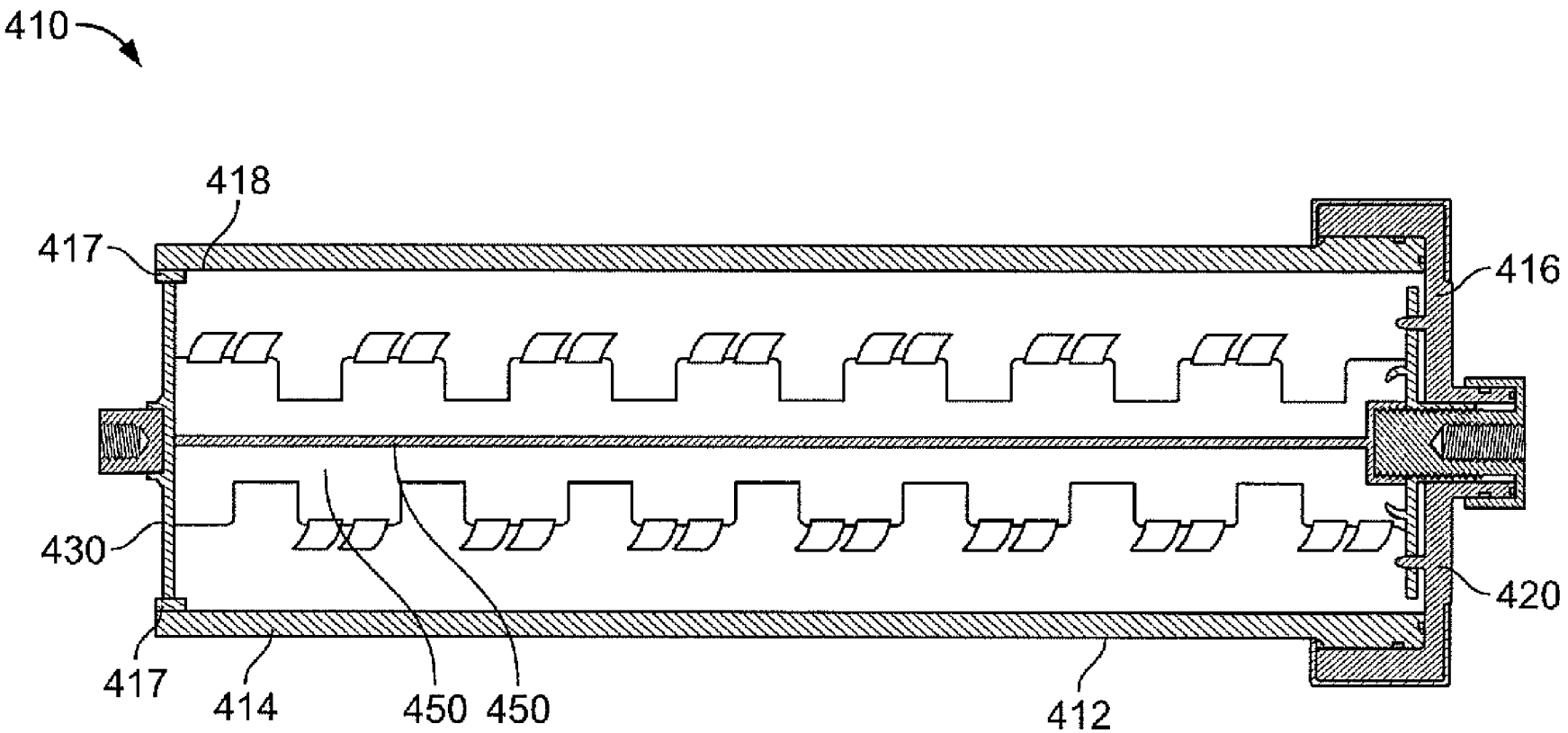
FIG. 4 is a cross-sectional view of another implementation of a current limiting fuse assembly.

Referring to FIG. 4, in another implementation, a current limiting fuse assembly 410 includes a housing 412 that contains a fuse element 450 that is analogous to the fuse element 50 described with respect to FIGS. 1 and 2. Housing 412 differs from housing 12, described above, as follows. Housing 412 includes a cylindrical member 414 that is analogous to tubular member 14, described above, except that tubular member 414 has both first and second open end portions 416 and 418. Attached to first open end portion 416 is a cap 420 that is analogous to the cap 20, described above. Second open end portion 416 is covered by a conventional non-integral metal end plate 430. End plate 430 is attached to second open end portion 416 by an adhesive 417, such as epoxy, as is known in the art, or by molding the plate 430 into the open end portion 416.

Figure 5:
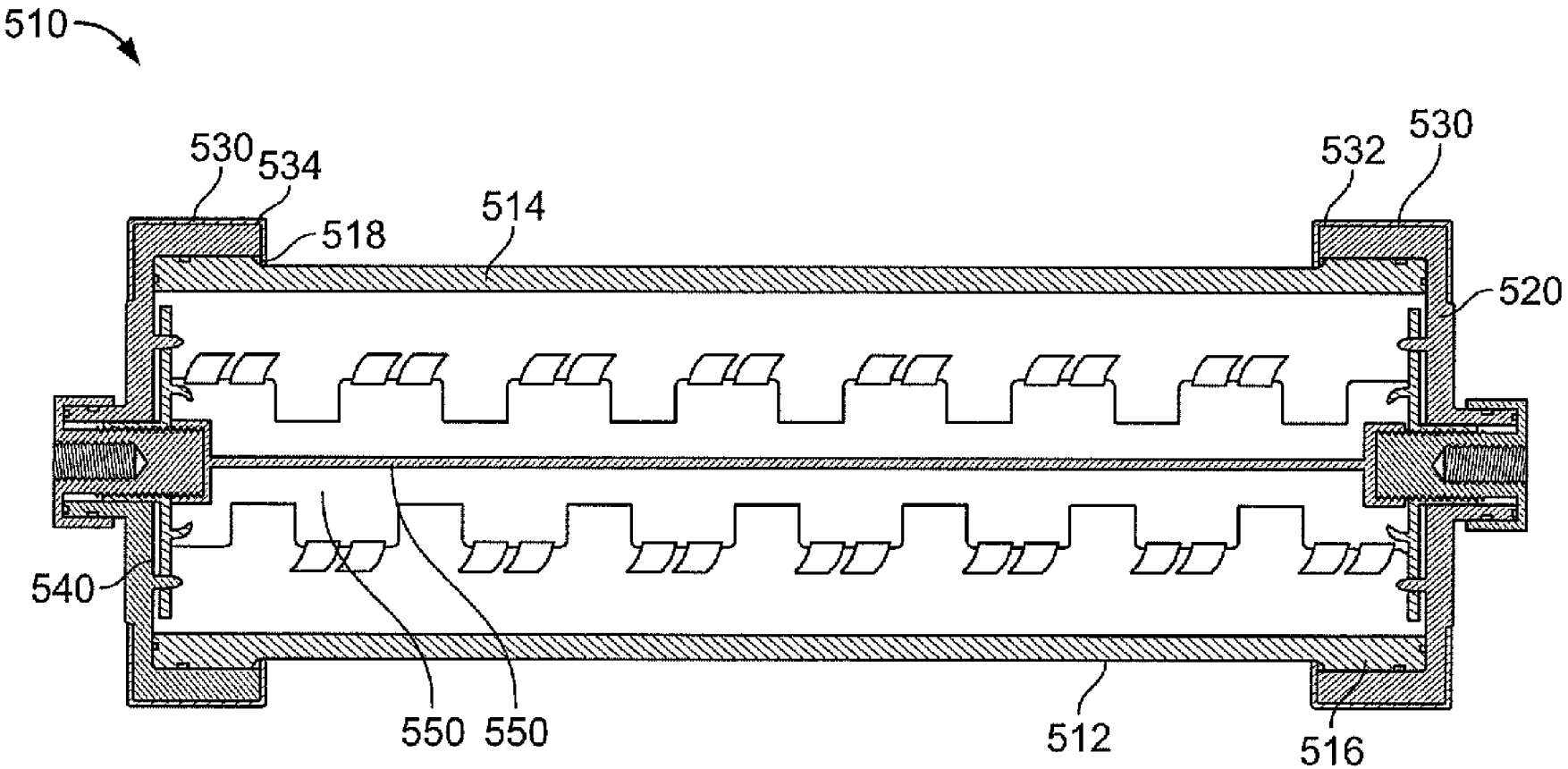
FIG. 5 is a cross-sectional view of another implementation of a current limiting fuse assembly.

Referring to FIG. 5, in another implementation, a current limiting fuse assembly 510 includes a housing 512 that contains a fuse element 550 that is analogous to the fuse element 50 described above with respect to FIGS. 1 and 2. Housing 512 differs from housing 12, described above, as follows. Housing 512 includes a tubular member 514 that has first and second open end portions 516 and 518. First open end portion 516 is attached to a first cap 520 that is analogous to cap 20, described above. Second open end portion 518 is attached to a second cap 540 that is analogous to the first cap 20. Both of caps 520 and 540 are attached to tubular member 514 by fastening members 530, such as metal clips 532 and 534, that are analogous to fastening members 30, described above, to prevent separation of the tubular member 514 from the caps 520 and 540 when the fuse element 550 melts.

Figure 6:
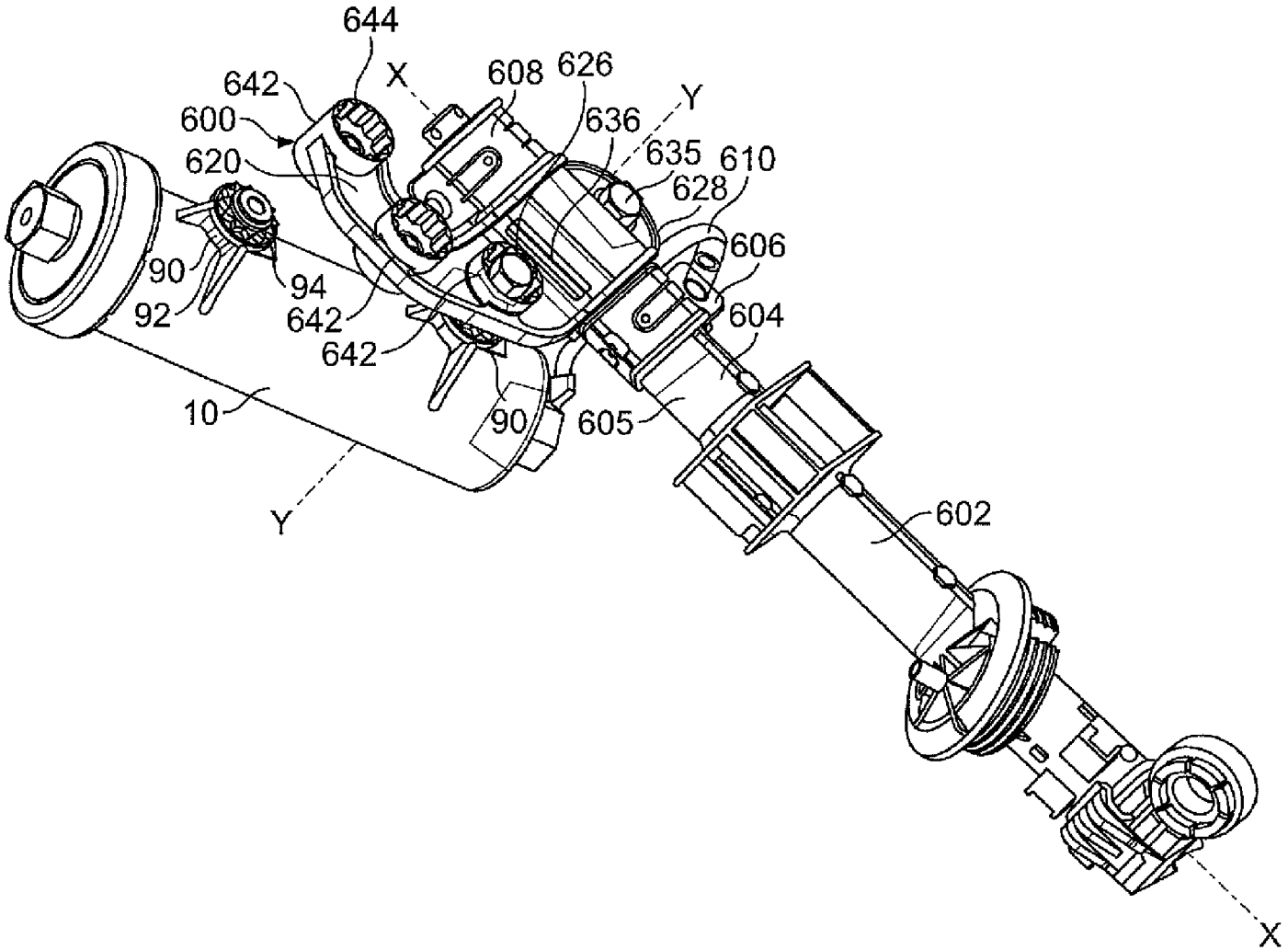
FIG. 6 is a perspective view of the current limiting fuse assembly of FIG. 1 coupled by a mounting member to a bayonet fuse assembly.

Referring to FIG. 6, a mounting assembly 600 couples current limiting fuse assembly 10 to another element, such as a bayonet fuse assembly 602, examples of which are described in the above-mentioned U.S. Pat. No. 5,936,507. Bayonet fuse assembly 602 includes an outer tube 604 that defines a longitudinal axis X. Bayonet fuse assembly 602 also includes contacts 606 and 608, one of which is attached to a wire lead 610 that is attached to one end of current limiting fuse 10.

Figure 7A:
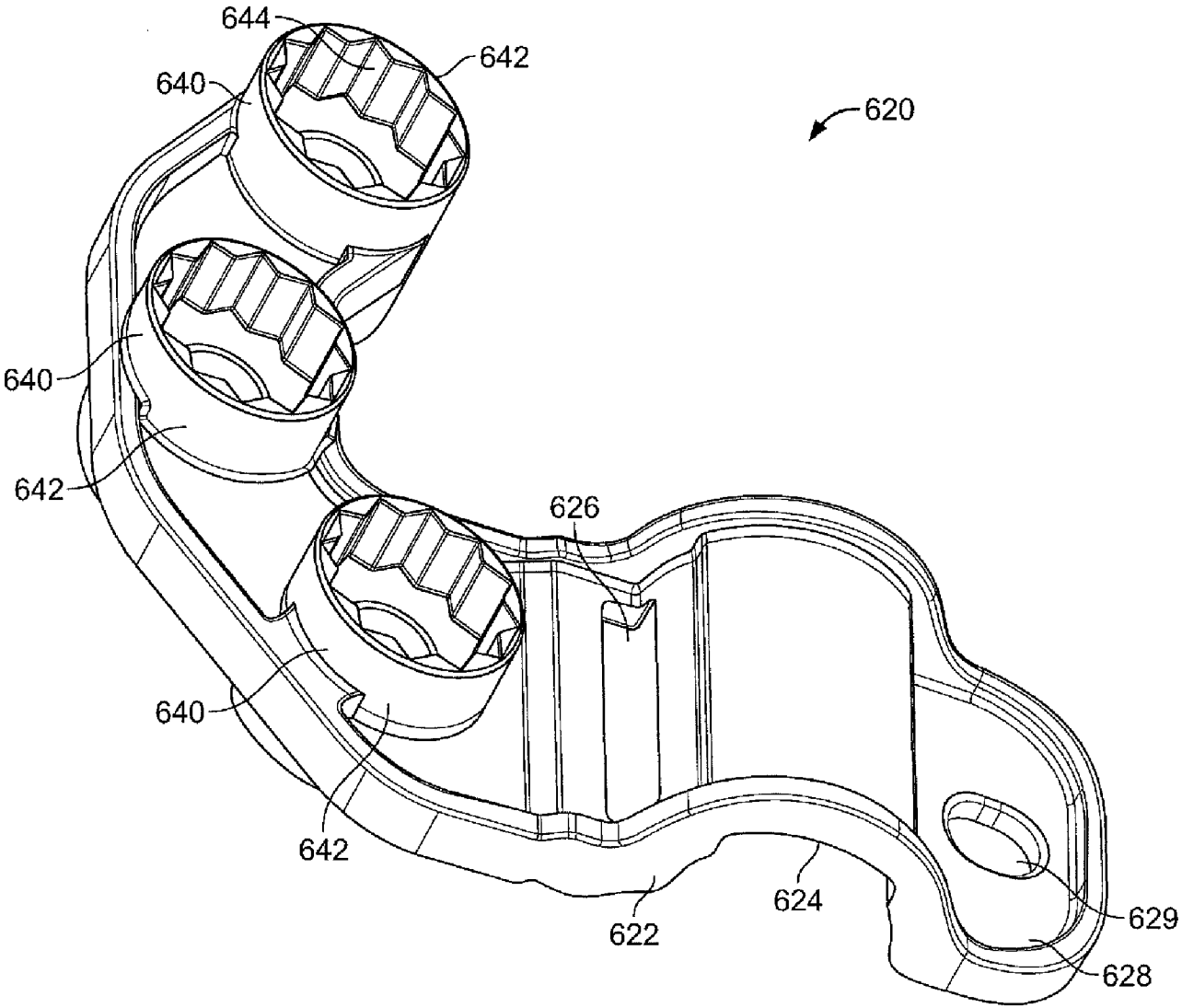
FIG. 7A is a perspective view of an upper bracket of the mounting member of FIG. 6.
Figure 7B:
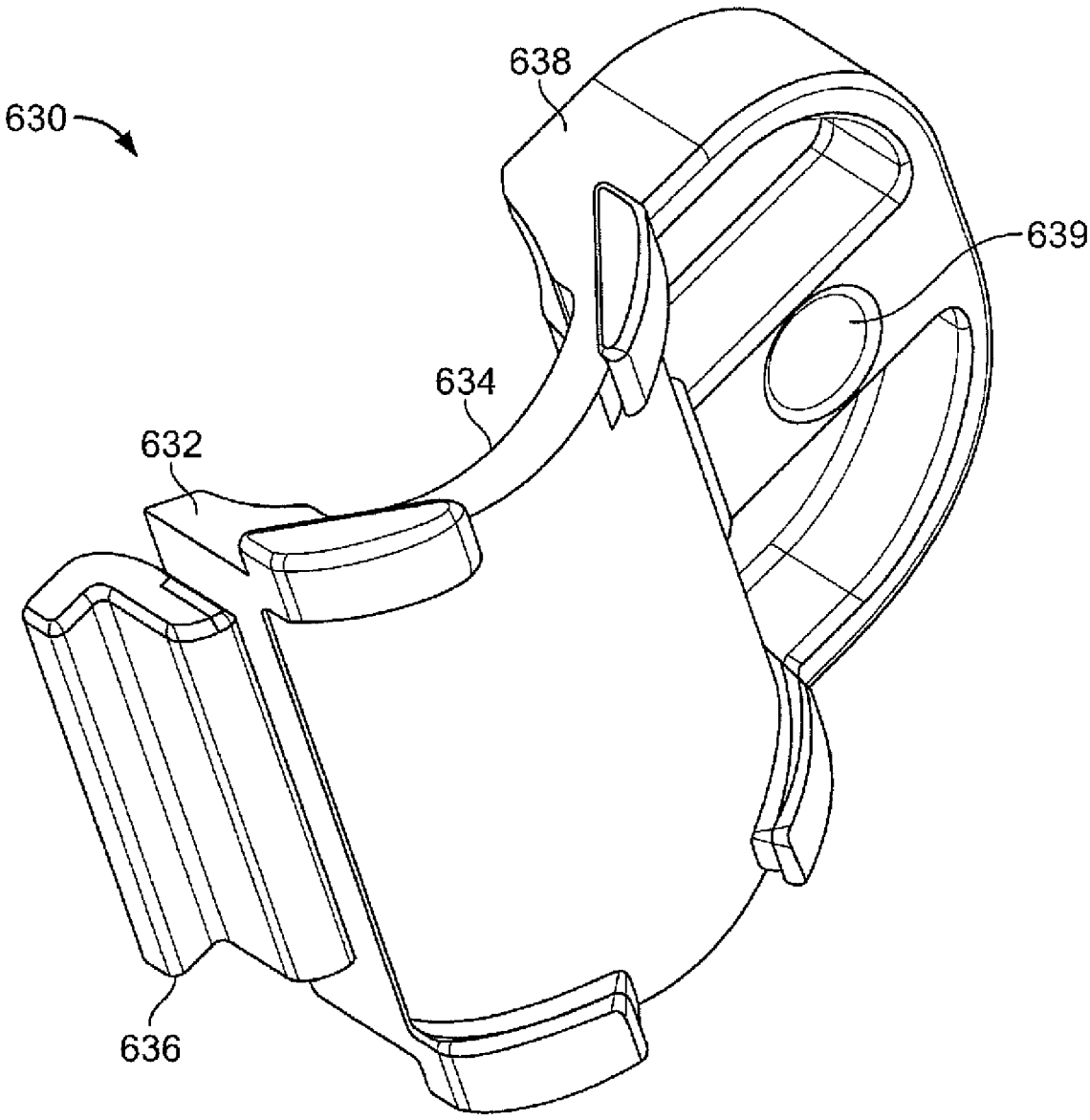
FIG. 7B is a perspective view of a lower bracket of the mounting member of FIG. 6.

Referring also to FIGS. 7A and 7B, mounting assembly 600 includes an upper bracket 620 and a lower bracket 630. Upper bracket 620 and lower bracket 630 each include concave portions 622 and 632 that, when facing each other, wrap around and receive tube 604 of bayonet fuse assembly 602. The concave portions 622 and 632 further include respective flattened regions 624 and 634. Flattened regions 624 and 634 correspond to an exterior surface 605 of tube 604, which has a square cross-section. The flattened regions permit mounting assembly 600 to be mounted to tube 604 at 90 degree intervals about longitudinal axis X.

Upper bracket 620 includes a groove 626 and lower bracket 630 includes a corresponding tab 636 that fits into groove 626 to align upper bracket 620 with lower bracket 630. Upper and lower brackets 620 and 630 also include corresponding respective flanges 628 and 638, each of which defines a respective bore 629 or 639 for receiving a fastener, such as a bolt or set screw 635 that clamps upper and lower brackets 620 and 630 about tube 604. Coupled to and in a fixed position relative to upper bracket 620 are three attachment members 640. Each attachment member 640 includes a cylindrical socket 642 having interior grooves 644 arranged in a star-shaped pattern.

Referring also to FIG. 1, current limiting fuse 10 includes two attachment members 90 integrally formed on the exterior of housing 12. Each attachment member 90 includes a conical projection 92 having exterior teeth 94 in a star-shaped pattern and an interior bore 96 for receiving a fastener. Either of the two conical projections 92 can be received in any of the three sockets 642. The exterior teeth 94 are received in the interior grooves 644 such that the fuse 10 can be attached to mounting assembly 600 in one of several positions about an axis Y that is non-parallel to longitudinal axis X. Conical projection 92 is secured in socket 642 by inserting a fastener (e.g., bolt 650) into bore 96 in conical projection 92. The multiple projections 92 and sockets 642 allow fuse 10 to be attached to mounting assembly 600 in a variety of positions.

Figure 8:
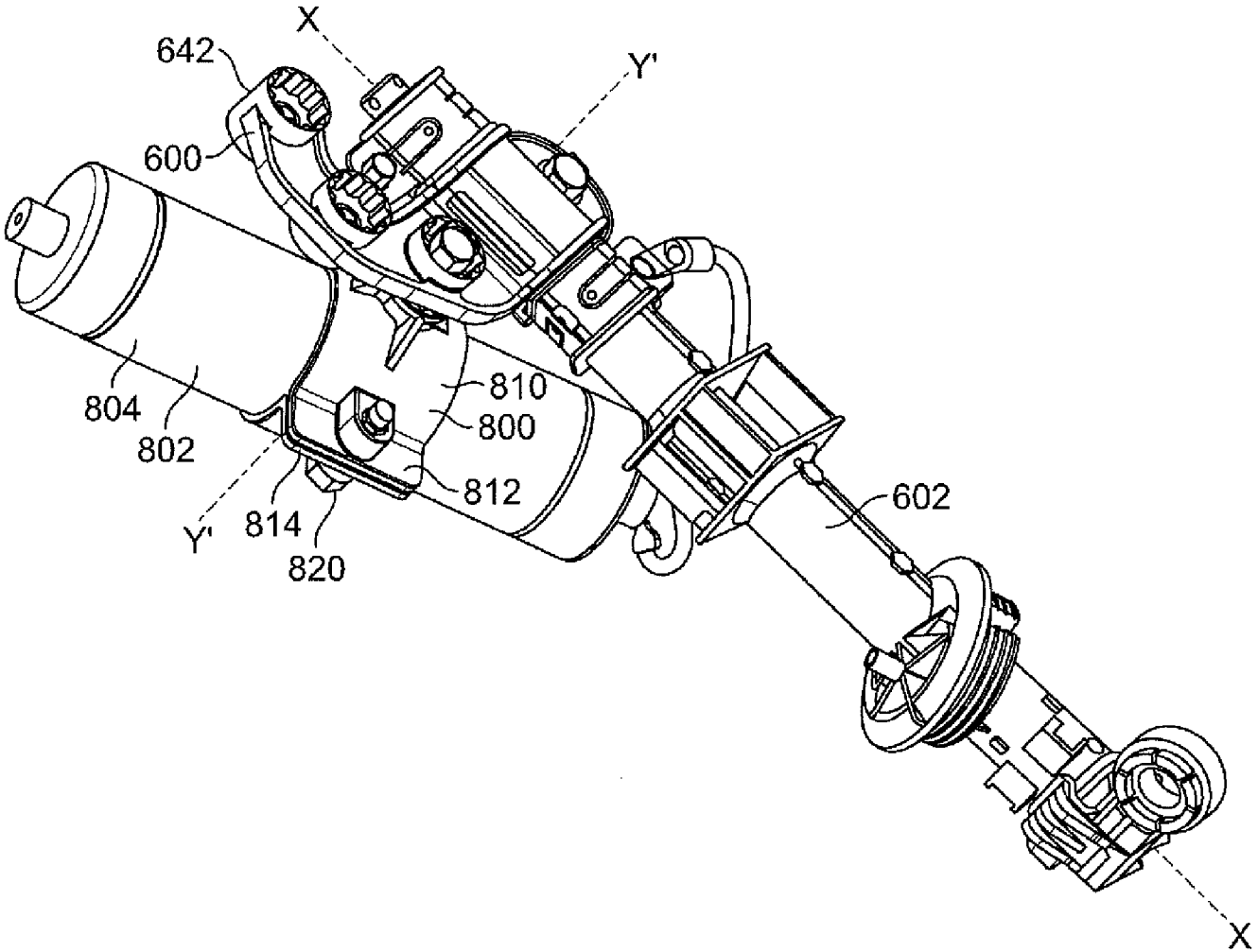
FIG. 8 is a perspective view of another current limiting fuse assembly retrofitted with a clamp and attached to the mounting member and a bayonet fuse assembly of FIG. 1.
Figure 9:
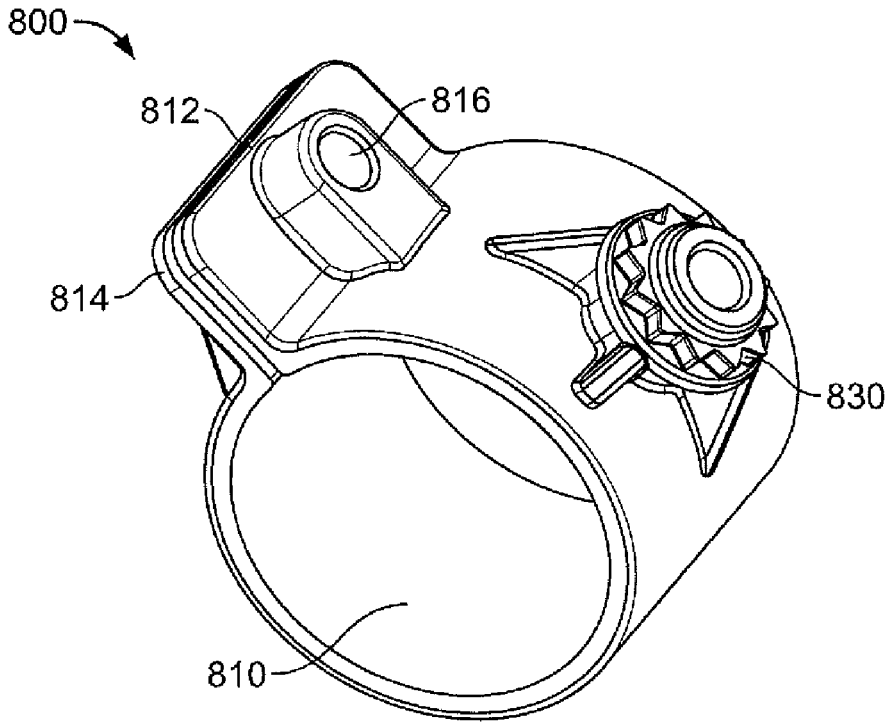
FIG. 9 is a perspective view of the clamp of FIG. 8.

Referring to FIGS. 8 and 9, in another implementation, a clamp 800 can be used to retrofit a current limiting fuse 802 with a housing 804 that lacks integral attachment members for attachment to mounting assembly 600. Clamp 800 includes a split-ring 810 that fits over housing 804. Split-ring 810 includes a pair of flanges 812 and 814 each of which includes a bore 816 for receiving a fastener such as a bolt 820 that secures split-ring 810 to housing 804 in one of several positions relative to a longitudinal axis Y of the fuse 802. Fixedly attached to split-ring 810 is an attachment member 830 that is analogous to the attachment members 90 described above. Attachment member 830 fits into sockets 642 on mounting assembly 600 such that fuse 802 can be mounted to mounting assembly 600 in one of several positions about an axis Y' that is non-parallel to longitudinal axis X of bayonet fuse assembly 602.

Figure 10:
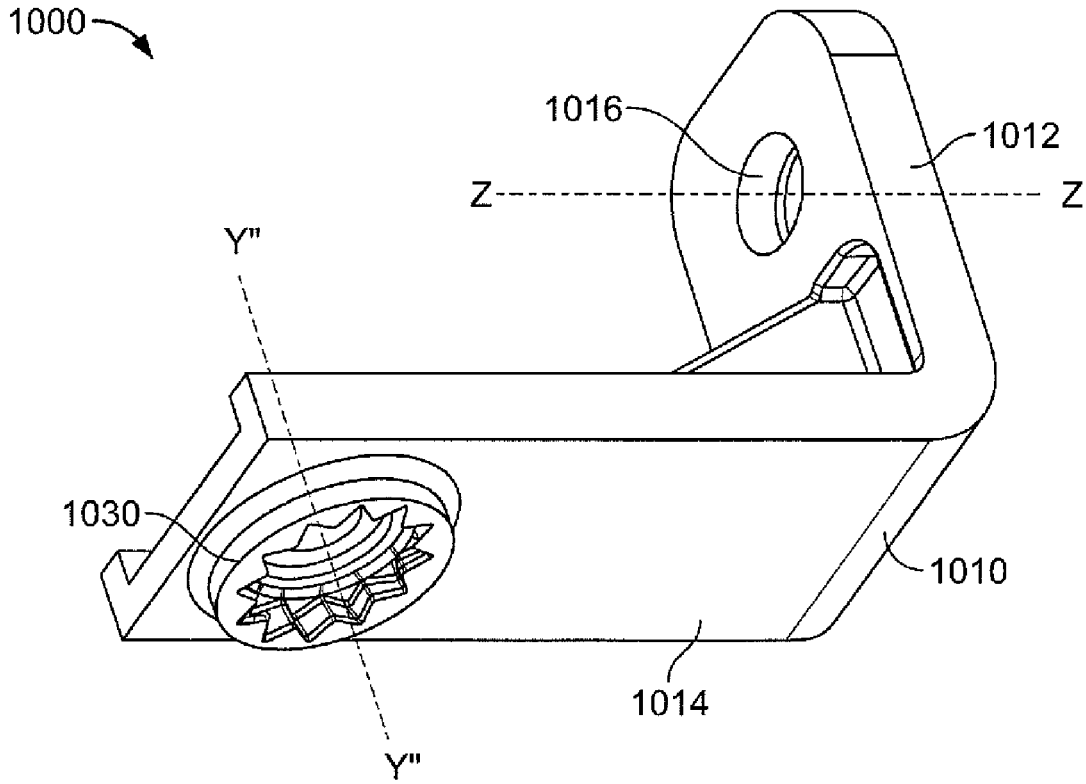
FIG. 10 is a perspective view of another implementation of a mounting member.

Referring to FIG. 10, in another implementation, a mounting assembly 1000 can be used to mount one of the fuse assemblies described above to a flat surface, such as a wall. Mounting assembly 1000 includes an L-shaped bracket 1010 with a parallel leg 1012 to be mounted substantially parallel to the wall and a perpendicular leg 1014 to be mounted substantially perpendicular to the wall. Parallel leg 1012 includes a bore 1016 that receives a fastener (not shown), such as a bolt, that attaches the parallel leg 1012 to the wall in one of several positions about an axis Z that is perpendicular to the wall. Perpendicular leg 1014 includes an attachment member 1030 that is analogous to the attachment members 640 described above. Attachment member 1030 receives projections 92, described above, such that the fuse can be mounted to mounting assembly 600 in one of several positions about axis Y" that is non-parallel to axis Z.

A number of implementations have been described. Nevertheless, it will be understood that various modifications may be made. For example, the fuse may be rated for use at a lower or higher amperage, or at a lower or higher voltage. The shape of the fuse element can be straight rather than coiled, and multiple metal fuses can be included within the housing. The housing may be filled with something other than silica sand. The housing may be composed of other types of insulating materials such as plastic or rubber. The cap and the tubular member can have different lengths than shown in the figures. Similarly, the two tubular members can have lengths that differ from one another.

In addition to or instead of the metal clip or threads, other attachment members can be used to secure the parts of the housing together. The metal ring can be shaped by using magnetic fields to shape the fingers of the ring and hold the parts together. The metal ring can be mechanically crimped into place. Composite wrap type materials can be placed over each molded part and cured. Snap fit projections can slide over one part and snap into place to hold the fuse cap and fuse housing together. Twist lock shapes can attach the parts. Projections on one part can pass through a hole in a flange on the other part and can be melted under pressure. The parts can be joined together by ultrasonic welding, induction heating, with or without special fillers, or hot plate welding. A flange can be formed on both the fuse cap and on the fuse housing with holes projecting through the flanges for receiving fasteners, such as, nuts and bolts, self-tapping screws, and rivets. Similar techniques can be used to attach projections to the housing for attachment to the mounting member. In addition to the foregoing, the parts can be joined by adhesives such as epoxy or urethane.

The sealing members on the fuse cap and fuse housing may be made by melting the end contacts into the molded plastic parts. This may be accomplished by heating the parts in an oven and pressing them together or by using an induction heater to heat the metal parts, while pressing the parts into place or applying force to the plastic. The metal parts may be coated with materials that reflow during heating and then solidify. These coatings may concentrate the heat and/or form adhesive or mechanical seals between the molded plastic and metal parts.

The mounting member may be formed as an integral part of the mounting component (e.g., the bayonet fuse assembly). The mounting bracket may be formed from a conductive material such as copper and may be formed to mate with the mounting stud of a high voltage bushing used, for example, to connect a transformer to cables of an electrical system. The mounting member may have a smaller or larger number of sockets and the fuse may have a smaller or larger number of projections. The grooves and the teeth on the sockets and the projections may be larger or fewer in number and may have different shapes than those shown. The mounting member may include the projections, while the fuse includes the sockets. The tube of the bayonet fuse assembly may have any shape cross section, such as circular or hexagonal, or other features, such as bumps or grooves, that allow the mounting member to be mounted to the bayonet fuse assembly at additional positions.

Several possible components may be attached to the current limiting fuse, including, for example, a high voltage bushing, a bayonet fuse assembly, a MagneX interrupter, a load break switch used to reconfigure a cable system, a high voltage switch used to turn a transformer on or off, and a dual voltage or tap changing switch.

These and other implementations are within the scope of the following claims.

What is claimed is:

1. A mounting assembly for coupling a current limiting fuse to an element that defines a longitudinal axis, the mounting assembly comprising:

a mounting member configured to be mounted on the element in a plurality of discrete positions about the longitudinal axis of the element;

a first attachment member coupled to the mounting member in a fixed position relative to the mounting member; and a second attachment member coupleable to the current limiting fuse, wherein the first and second attachment members are configured to be attached to one another in a plurality of discrete positions about an axis that is non-parallel to the longitudinal axis, and the element comprises a bayonet fuse.

2. The mounting assembly of claim 1 wherein the bayonet fuse comprises a tube having a cross section and the mounting member is configured to be mounted to the tube at 90 degree intervals about the longitudinal axis.

3. The mounting assembly of claim 1 wherein the element comprises a wall and the longitudinal axis is perpendicular to the wall.

4. The mounting assembly of claim 3 wherein the mounting member comprises an L-shaped bracket with a leg configured to be mounted to the wall.

5. The mounting assembly of claim 1 wherein the mounting member comprises a first piece and a second piece.

6. The mounting assembly of claim 5 wherein the first piece defines a slot and the second piece has a tab that fits into the slot.

7. The mounting assembly of claim 5 wherein the mounting member further comprises a fastener for attaching the first piece to the second piece.

8. The mounting assembly of claim 5 wherein the first piece has a first concave portion and the second piece has a second concave portion, the first and second concave portions facing each other to receive the element therebetween.

9. The mounting assembly of claim 8 wherein the first concave portion includes a first flattened region and the second concave portion includes a second flattened region, the first and second flattened regions allow the mounting member to be mounted to the element at a plurality of discrete positions about the longitudinal axis.

10. The mounting assembly of claim 1 wherein the first attachment member comprises a socket that includes a plurality of grooves.

11. The mounting assembly of claim 10 wherein the second attachment member comprises a projection that includes a plurality of teeth corresponding to the grooves.

12. The mounting assembly of claim 1 further comprising a third attachment member coupled to the mounting member in a fixed position relative to the mounting member, wherein the second attachment member is configured to be attached to the first attachment member or the third attachment member in a plurality of discrete positions about an axis that is non-parallel to the longitudinal axis.

13. The mounting assembly of claim 1 further comprising a third attachment member couplable to the current limiting fuse, wherein the first attachment member is configured to be attached to the second attachment member or the third attachment member in a plurality of discrete positions about an axis that is non-parallel to the longitudinal axis.

14. The mounting assembly of claim 1 wherein the second attachment member is integral with the current limiting fuse.

15. The mounting assembly of claim 1 wherein the second attachment member is removeable from the current limiting fuse.

16. The mounting assembly of claim 15 wherein the second attachment member is integral with a clamp that removably couplable to the current limiting fuse.

17. A mounting assembly for coupling a current limiting fuse to an element that defines a longitudinal axis, the mounting assembly comprising:

a mounting member configured to be mounted to the element in a plurality of positions about the longitudinal axis;

a first attachment member coupled to the mounting member in a fixed position relative to the mounting member; and a second attachment member coupleable to the current limiting fuse, wherein:

the first and second attachment members are configured to be attached to one another in a plurality of discrete positions about an axis that is non-parallel to the longitudinal axis, the mounting member comprises a first piece and a second piece, and the first piece has a first concave portion and the second peice has a second concave portion, the first and second concave portions facing each other to receive the element therebetween.

18. The mounting assembly of claim 17, wherein the first concave portion includes a first flattened region and the second concave portion includes a second flattened region, the first and second flattened regions allow the mounting member to be mounted to the element at a plurality of discrete positions about the longitudinal axis.

19. A mounting assembly for coupling a current limiting fuse to an element that defines a longitudinal axis, the mounting assembly comprising:

a mounting member configured to be mounted to the element in a plurality of positions about the longitudinal axis;

a first attachment member coupled to the mounting member in a fixed position relative to the mounting member; and a second attachment member coupleable to the current limiting fuse, wherein:

the first and second attachment members are configured to be attached to one another in a plurality of discrete positions about an axis that is non-parallel to the longitudinal axis, the mounting member comprises a first piece and a second piece, and the first piece defines a slot and the second piece has a tab that fits into the slot.

20. A mounting assembly for coupling a current limiting fuse to an element that defines a longitudinal axis, the mounting assembly comprising:

a mounting member configured to be mounted to the element in a plurality of positions about the longitudinal axis;

a first attachment member coupled to the mounting member in a fixed position relative to the mounting member; and a second attachment member coupleable to the current limiting fuse, wherein:

the first and second attachment members are configured to be attached to one another in a plurality of discrete positions about an axis that is non-parallel to the longitudinal axis, and the first attachment member comprises a socket that includes a plurality of grooves.

21. The mounting assembly of claim 20 wherein the second attachment member comprises a projection that includes a plurality of elements configured to be received in the grooves.

* * * * *